US008783483B2

(12) United States Patent
Faragher et al.

(10) Patent No.: US 8,783,483 B2
(45) Date of Patent: Jul. 22, 2014

(54) CHILD-RESISTANT CLOSURE

(75) Inventors: Stephen Faragher, Norfolk (GB); Jamie Fox, Norfolk (GB); Darren John Mears, Norwich (GB)

(73) Assignee: Obrist Closures Switzerland GmbH (CH)

( * ) Notice: Subject to any disclaimer, the term of this patent is extended or adjusted under 35 U.S.C. 154(b) by 0 days.

(21) Appl. No.: 13/514,366

(22) PCT Filed: Oct. 29, 2010

(86) PCT No.: PCT/GB2010/002012

§ 371 (c)(1),
(2), (4) Date: Jul. 10, 2012

(87) PCT Pub. No.: WO2011/073606

PCT Pub. Date: Jun. 23, 2011

(65) Prior Publication Data

US 2012/0267336 A1 Oct. 25, 2012

(30) Foreign Application Priority Data

Dec. 18, 2009 (GB) ..... 0922117.7

(51) Int. Cl.

| | |
|---|---|
| ***B65D 50/02*** | (2006.01) |
| ***B65D 41/00*** | (2006.01) |
| ***B65D 51/18*** | (2006.01) |
| ***B65D 51/04*** | (2006.01) |
| ***B65D 47/00*** | (2006.01) |
| ***B65D 50/04*** | (2006.01) |
| ***B65D 47/08*** | (2006.01) |

(52) U.S. Cl.

CPC ..... *B65D 50/046* (2013.01); *B65D 2251/1058* (2013.01); *B65D 47/0838* (2013.01)

USPC ..... 215/224; 215/216; 215/235; 215/237; 220/254.3; 220/254.5; 222/556

(58) Field of Classification Search

USPC ..... 215/224, 216, 235, 237, 206, 211; 220/254.3, 254.5; 222/556

See application file for complete search history.

(56) References Cited

U.S. PATENT DOCUMENTS 3,402,842 A * 9/1968 Millian ..... 215/217
3,747,793 A * 7/1973 Wassilieff ..... 215/250

(Continued)

FOREIGN PATENT DOCUMENTS

GB 1484517 9/1977
GB 2449704 3/2008

(Continued)

OTHER PUBLICATIONS

Derbal, Jamel "International Search Report and Written Opinion" International Application No. PCT/GB2010/002012, European Patent Office; Jan. 17, 2011.

(Continued)

*Primary Examiner* — Fenn Mathew
*Assistant Examiner* — Don M Anderson
(74) *Attorney, Agent, or Firm* — Bradley Arant Boult Cummings LLP

(57) ABSTRACT

A child-resistant closure (10) is provided and comprises a base (15) and a lid (20). The base has an inner skirt (50) and an outer skirt (25). The closure has locking means (81, 86) tor releasably locking the lid in a closed position. The outer skirt has one or more pressing zones (80, 85) which can be pressed to release the locking means. The inner skirt has one or more cut-outs (65, 70) in register with the or each pressing zone whereby to allow greater deflection thereof.

18 Claims, 5 Drawing Sheets

(56) References Cited

U.S. PATENT DOCUMENTS

| | | | | |
|---|---|---|---|---|
| 3,989,152 | A | 11/1976 | Julian | |
| 4,759,455 | A * | 7/1988 | Wilson | 215/206 |
| 5,096,077 | A * | 3/1992 | Odet et al. | 215/211 |
| 5,765,705 | A * | 6/1998 | Deubel | 215/216 |
| 5,865,354 | A * | 2/1999 | Bansal | 222/546 |
| 6,321,924 | B1 * | 11/2001 | Yurkewicz et al. | 215/251 |
| 6,357,615 | B1 * | 3/2002 | Herr | 215/216 |
| 6,536,617 | B2 * | 3/2003 | White et al. | 215/320 |
| 6,866,164 | B2 * | 3/2005 | Branson et al. | 222/153.14 |
| 7,451,896 | B2 * | 11/2008 | Robinson | 222/153.14 |
| 7,870,980 | B2 * | 1/2011 | Wilson et al. | 222/571 |
| 2002/0175137 | A1 * | 11/2002 | Rousselet | 215/235 |
| 2003/0201283 | A1 | 10/2003 | Branson et al. | |
| 2005/0133475 | A1 * | 6/2005 | Goto et al. | 215/237 |
| 2005/0205607 | A1 * | 9/2005 | Hierzer et al. | 222/153.1 |
| 2007/0144996 | A1 * | 6/2007 | Sawyer | 215/235 |
| 2009/0223985 | A1 | 9/2009 | Carmody et al. | |

FOREIGN PATENT DOCUMENTS

| | | |
|---|---|---|
| JP | 2003292004 | 10/2003 |
| WO | WO9821113 | 5/1998 |
| WO | WO03011701 | 2/2003 |

OTHER PUBLICATIONS

Williams, Darren "Search Report" Application No. GB0922117.7, Great Britain Intellectual Property Office, Apr. 13, 2010.

Haon, Jean-Noel "Communication Under Rule 71(3) EPC—EP application No. 10777074.5-1707" Oct. 30, 2013; pp. 1-20.

* cited by examiner

CHILD-RESISTANT CLOSURE

CROSS-REFERENCE TO RELATED APPLICATIONS

This application is a national stage under 35 U.S.C. 371 of International Application PCT/GB2010/002012, filed on Oct. 29, 2010 (currently pending). International Application PCT/GB2010/002012 cites the priority of British Patent Application 0922117.7, filed Dec. 18, 2009 (currently pending).

The present invention relates generally to a child-resistant closure and particularly to a closure in which squeezing and/or pressing is required in order to gain access.

Many different types of safety closure, or child-resistant closure, have been proposed. It is known to provide closures in which a base and a lid is provided and in order to open the lid part of the base must be squeezed, usually to release a lug or the like which retains the lid. An example of this type of closure is disclosed in DE3625477.

In any child-resistant closure one important consideration is the balance between being easy enough for adults to open and yet not so easy that a child can gain access. In known "squeeze to release" closures there can be problems with the amount of deflection permitted which then results in difficulties releasing the lugs.

The present invention seeks to address the problems with known child-resistant, squeeze-to-release closures.

According to the present invention there is provided a child-resistant closure comprising a base and a lid, the base having an inner skirt and an outer skirt, the closure further having locking means for releasably locking the lid in a closed position, the outer skirt having one or more pressing zones which can be pressed to release the locking means, in which the inner skirt has one or more cut-outs in register with the or each pressing zone whereby to allow greater deflection thereof.

By providing cut-outs in the inner skirt the outer skirt can be deflected further inwards to disengage the locking means. A reduction in materials can result, both from the removal of material to make the cut-outs and material savings which can be made due to the increased wall deflection.

The locking means may comprise a locking lug movable to an unlocked position by the pressing zone. Typically the lug would be biased to a locking position to allow re-set.

The lid may have one or more slots for receiving the or each locking lug and in the locked position the lug/s may project through the slot/s.

The lid may be connected to the base by a hinge, such as a snap hinge. Alternatively the lid may be releasable from the base.

The pressing zone/s may comprise a pressing pad. In some embodiments the zone may comprise a recessed panel. The locking means may be carried on or by the zone.

The outer skirt may comprise two pressing zones with the inner skirt comprising two corresponding cut-outs. The zones may be diametrically opposed to each other.

The closure base may further comprise a finger recess for lifting the lid following release of the locking means. The finger recess may be positioned diametrically opposite an articulation member such as a hinge if present.

The inner skirt may comprise retention means for securing the closure to a container. The retention means comprise a locking bead, which may be segmented.

The cut-out may comprise a notch. The notch may extend over part or substantially the full height of the inner wall. Alternatively, the cut-out may comprise a window in the inner wall.

The present invention will now be more particularly described, by way of example, with reference to the accompanying drawings, in which.

Figure 1:
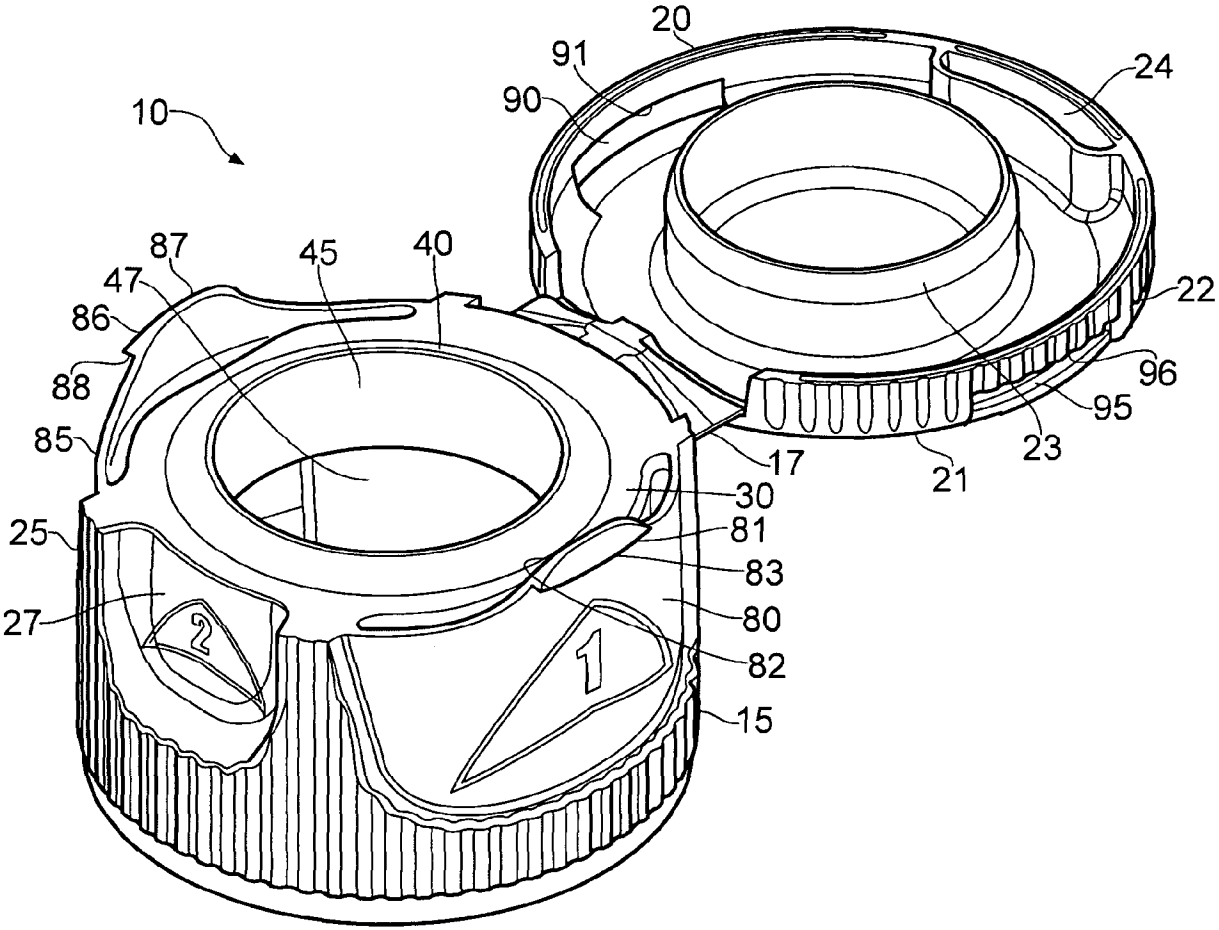
FIG. 1 is a perspective view of a closure formed according to the present invention shown in an open position.

As shown in the figures, a closure is provided and is generally indicated 10. The closure 10 comprises a base 15 and a lid 20.

The base 15 comprises a generally cylindrical outer skirt 25. At the end of the skirt 25 which is adjacent to the lid an annular deck 30 extends radially inwardly. The inner periphery of the deck 30 terminates with an upwardly (with reference to the lid) inclined spout section 40. At the inner periphery of the spout section 40 a truncated spout skirt 45 depends and defines an aperture 47. At the outer periphery of the spout section where it joins the flat section of the deck an inner skirt 50 depends. The inner skirt 50 is split into two identical arcuate sections 55, 60 which are positioned diametrically opposed to each other and separated by two generally U-shaped cut-out sections 65, 70. The inner skirt sections extend so that their free ends terminate at approximately the same position as the outer skirt. The cut-out sections extend from the free end of the arcuate sections all the way to the spout sections.

The outer skirt includes two diametrically opposed generally elongated U-shape recesses defined by panels 80, 85. The recesses are in register with the cut-outs as will be discussed in more detail below.

Each panel 80, 85 carries a lug 81, 86 which projects above the deck. Behind each recess on the deck 30 is an arcuate slot.

Each lug 81, 86 comprises a chamfered upper surface 82, 87 and an undercut low surface 83, 88.

The recess panels can be deflected inwards which in turn moves the lugs radially inwards. The panels are resilient and automatically spring back to the position shown in the drawings.

Figure 6:
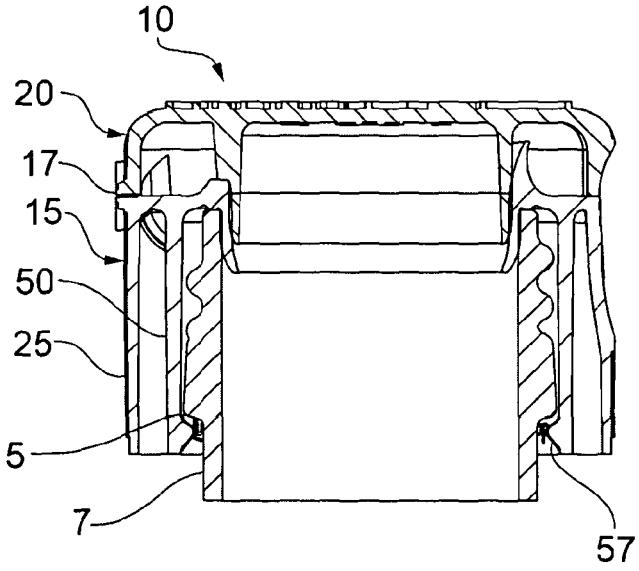
FIG. 6 is a section of the closure of FIG. 4 shown attached to a container neck.

Each of the arcuate inner skirt sections 55, 60 comprises three spaced bead sections 57 at their free end which in use engage on a corresponding snap bead 5 on a container neck 7 as shown in FIG. 6.

The base 15 and lid 20 are joined by a hinge 17, which in this embodiment is a snap hinge. Diametrically opposite the hinge a finger recess 27 is positioned in the outer skirt 25.

The lid 20 comprises a generally circular top plate 21 with a truncated side skirt 22 depending from its periphery except for the region where the hinge 17 is attached.

A centrally positioned annular spigot 23 depends from the top plate 21 and is dimensioned to be a tight fit in the aperture 47 defined by the spout 40 in the base when the lid is in the closed position.

Two diametrically opposed slots 90, 95 are positioned in the lid 20 at the intersection of the skirt 22 and top plate 21. The slots are positioned so that when the lid is closed onto the base the lugs 81, 86 are engaged and firstly the chamfered portion 82, 87 of the lugs engages the free end of the skirt whereupon they are caused to deflect inwards until the lug passes into the slots whereupon they spring outwards to fill the slots. The lower surfaces 83, 88 of the lugs then engage onto the upper faces 91, 96 of the skirt sections which defines the slots.

Figure 2:
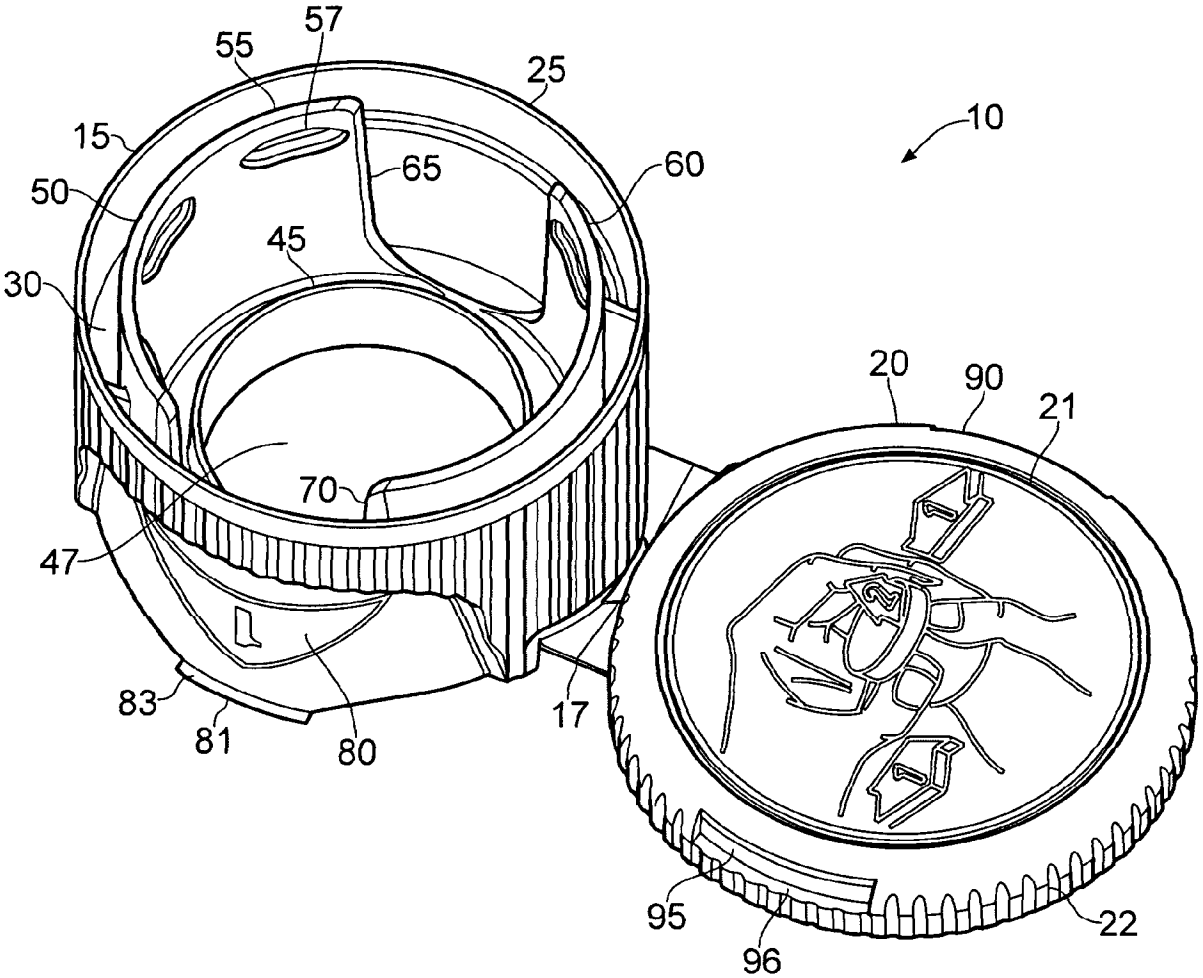
FIG. 2 is a perspective view showing the underside of the closure of FIG. 1.
Figure 3:
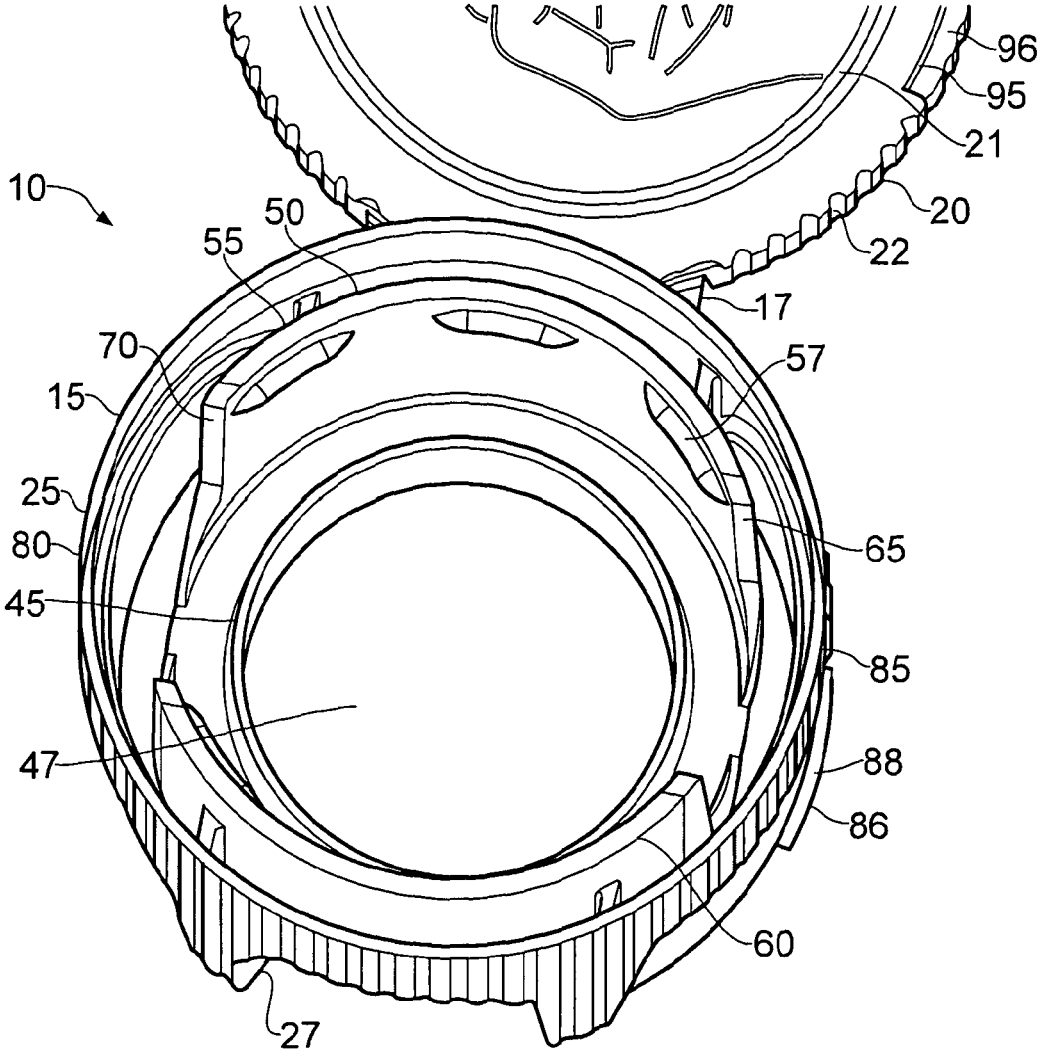
FIG. 3 is a further view of the underside of the closure of FIG. 1.
Figure 4:
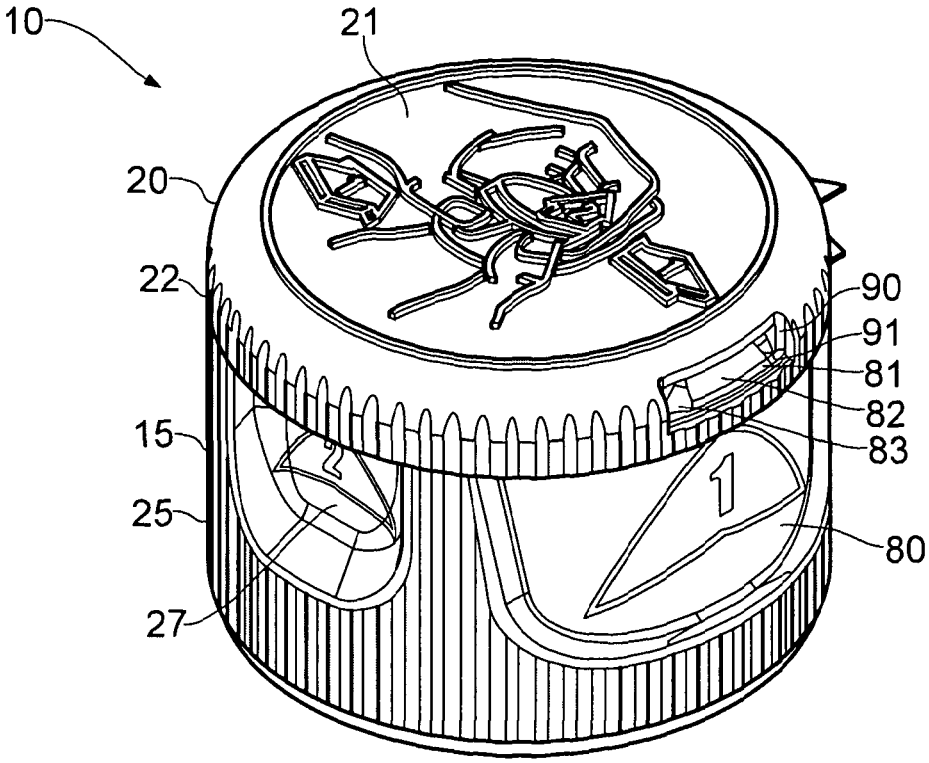
FIG. 4 is a perspective view of the closure of FIGS. 1 to 3 shown in a closed position.
Figure 5:
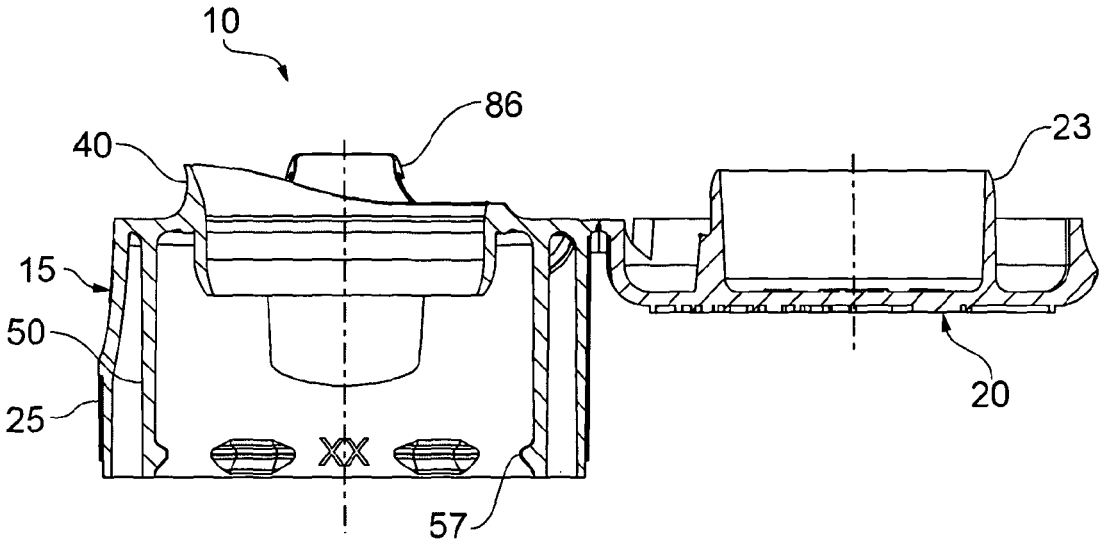
FIG. 5 is a section of the closure of FIG. 1.

In this closed position shown in FIGS. 4 and 6 the lid cannot be lifted because the slot base 91, 96 and lug surfaces 83, 88 are in abutment. In order to open the lid the recess panels must be pressed inwards to move the lugs out of the slots. Because the panels 80, 85 are in register with the cut-outs 65, 70 the panels can be deflected further radially inwards. At the same time the lugs are moved inwards the finger recess must be used to flip open the lid as is shown diagrammatically on the top of the lid in FIG. 2. The underside of the lid is provided with a trough 24 in register with the finger recess 27 in the closed position which serves as a leverage point to lift the lid.

The invention claimed is:

1. A child-resistant closure comprising a base and a lid connected by a hinge, the base having an inner skirt and an outer skirt depending from a deck, their free ends terminating at approximately the same position, the closure further having locking means for releasably locking the lid in a closed position, the outer skirt having one or more pressing zones which can be pressed to release the locking means in a radially inward movement, characterised in that the inner skirt has one or more cut-outs, which extend through the inner skirt, in register with the one or more pressing zones whereby to allow greater deflection thereof.

2. A closure as in claim 1, in which the locking means comprise a locking lug movable to an unlocked position by the pressing zone.

3. A closure as in claim 2, in which the lid has one or more slots for receiving each locking lug and in the locked position the one or more lugs project through the one or more slots.

4. A closure as in claim 1, in which each pressing zone comprises a recessed panel.

5. A closure as in claim 1, in which the pressing zone/s comprise a pressing pad.

6. A closure as in claim 1, in which the outer skirt comprises two pressing zones and the inner skirt comprises two corresponding cut-outs.

7. A closure as in claim 1, in which the inner skirt comprises retention means for securing the closure to a container.

8. A closure as in claim 7, in which the retention means comprise a locking bead.

9. A closure as in claim 8, in which the locking bead is segmented.

10. A closure as in claim 1, in which the cut-out comprises a notch.

11. A closure as in claim 10, in which the notch extends over substantially the full height of the inner skirt.

12. A closure as in claim 1, in which the cut-out comprises a window.

13. A closure as in claim 1, in which the inner skirt is split into two identical arcuate sections which are positioned diametrically opposed to each other and separated by two generally U-shaped cut-out sections, and in which the free end of the inner skirt sections extend so that they terminate at approximately the same position as the outer skirt.

14. A closure as in claim 1, in which the deck includes a spout section.

15. The closure as in claim 1 in combination with a container.

16. The closure of claim 1, wherein the one or more cut-outs divide the inner skirt into one or more arcuate sections.

17. A child-resistant closure comprising a base and a lid connected by a hinge, the base having an inner skirt and an outer skirt depending from a deck, their free ends terminating at approximately the same position, the closure further having a lock for releasably locking the lid in a closed position, the outer skirt having one or more pressing zones which can be pressed to release the lock in a radially inward movement, characterised in that the inner skirt has one or more cut-outs extending through the inner skirt in register with the one or more pressing zones whereby to allow greater deflection thereof.

18. The closure of claim 17, wherein the one or more cut-outs divide the inner skirt into one or more substantially identical arcuate sections.

* * * * *